US009257079B2

(12) United States Patent
Zhao

(10) Patent No.: US 9,257,079 B2
(45) Date of Patent: Feb. 9, 2016

(54) DATA DRIVING SYSTEM AND CHIP FOR LIQUID CRYSTAL PANEL AS WELL AS LIQUID CRYSTAL DISPLAY DEVICE

(75) Inventor: Dengxia Zhao, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 337 days.

(21) Appl. No.: 13/379,643

(22) PCT Filed: Jul. 19, 2011

(86) PCT No.: PCT/CN2011/077307

§ 371 (c)(1),
(2), (4) Date: Dec. 20, 2011

(87) PCT Pub. No.: WO2013/000184

PCT Pub. Date: Jan. 3, 2013

(65) Prior Publication Data

US 2012/0327054 A1 Dec. 27, 2012

(51) Int. Cl.
*G09G 5/00* (2006.01)
*G09G 3/36* (2006.01)

(52) U.S. Cl.
CPC ..... *G09G 3/3611* (2013.01); *G09G 2300/0408* (2013.01); *G09G 2370/08* (2013.01); *G09G 2370/14* (2013.01)

(58) Field of Classification Search
CPC ..... G09G 3/20; G09G 3/36; G09G 5/00; G09G 3/04; G09G 3/3611; G09G 2300/0408; G09G 2370/08; G09G 2370/14; H03K 19/003
USPC ..... 345/87–103, 204, 211, 214; 326/30, 86; 327/321, 328; 362/612; 455/127.1
See application file for complete search history.

(56) References Cited

U.S. PATENT DOCUMENTS

| | | | | |
|---|---|---|---|---|
| 6,611,249 | B1 * | 8/2003 | Evanicky et al. | 345/102 |
| 6,963,219 | B1 * | 11/2005 | Ghia et al. | 326/30 |
| 2004/0196279 | A1 * | 10/2004 | Kim et al. | 345/211 |
| 2004/0242171 | A1 * | 12/2004 | Hosokawa et al. | 455/127.1 |
| 2005/0088391 | A1 * | 4/2005 | Kim | 345/94 |
| 2007/0018686 | A1 * | 1/2007 | Yu et al. | 326/83 |
| 2007/0182690 | A1 * | 8/2007 | Lin | 345/100 |
| 2008/0144353 | A1 | 6/2008 | Lung | |
| 2008/0170063 | A1 * | 7/2008 | Ryu | 345/214 |
| 2008/0291154 | A1 * | 11/2008 | Huang | 345/102 |
| 2010/0149083 | A1 * | 6/2010 | Park et al. | 345/99 |
| 2010/0156885 | A1 * | 6/2010 | Cho et al. | 345/214 |

FOREIGN PATENT DOCUMENTS

| | | | |
|---|---|---|---|
| CN | 1560669 | A | 1/2005 |
| CN | 101140735 | A | 3/2008 |
| KR | 10-0917971 | B1 | 9/2009 |

* cited by examiner

*Primary Examiner* — Lun-Yi Lao
*Assistant Examiner* — Johny Lau
(74) *Attorney, Agent, or Firm* — Cheng-Ju Chiang

(57) ABSTRACT

A data driving system and a data driving chip for a liquid crystal panel as well as a liquid crystal display (LCD) device comprising the same are disclosed. The data driving system comprises a data driving chip, a timing controller and a first interface connected to the data driving chip and the timing controller. The first interface comprises a terminating resistor for converting a current signal transmitted through the first interface into a voltage signal, and the terminating resistor is disposed inside the data driving chip. By having the terminating resistor disposed inside the chip, the present disclosure can eliminate the need of additional electric tests, thus saving the cost of the additional electric tests.

12 Claims, 4 Drawing Sheets

DATA DRIVING SYSTEM AND CHIP FOR LIQUID CRYSTAL PANEL AS WELL AS LIQUID CRYSTAL DISPLAY DEVICE

FIELD OF THE INVENTION

The present disclosure generally relates to the technical field of liquid crystal displaying, and more particularly, to a data driving system and a data driving chip for a liquid crystal panel as well as a liquid crystal display (LCD) device comprising the same.

BACKGROUND OF THE INVENTION

In the modern information era, liquid crystal displays (LCDs) have found wide application in various aspects of people's life. For example, applications of the LCDs now range from small-sized products such as mobile phones, video cameras and digital still cameras, through medium-sized products such as notebook computers and desktop computers, to large-sized products such as TV sets and even large-scaled projection apparatuses. Because of such advantages as light weight, thin profile, perfect image quality and fast response, the LCDs have become the mainstream product in the display market.

Referring to FIG. 1, there is shown a panel driving architecture for prior art LCD devices in which X-circuit boards (PCB boards) and a C-circuit board (control board) are formed separately. In this architecture, the X-circuit boards function to transmit signals from the C-circuit board to data driving chips disposed on a liquid crystal panel.

Referring to FIGS. 2 and 3 together, FIG. 2 is a schematic view illustrating connections of a prior art mini-LVDS (Low Voltage Differential Signaling), and FIG. 3 is a schematic view illustrating a position where a terminating resistor is connected in the prior art. As shown in FIG. 2, in the schematic view illustrating connections of the mini-LVDS, a transmitting end (TX) inside a timing controller (TCON) transmits data to a receiving end (RX) of a data driving chip.

As shown in FIG. 3, the timing controller (TCON) on the C-circuit board and the data driving chip communicate with each other through mini-LVDS differential signals, and a signal transmitted from the transmitting end (TX) inside the timing controller (TCON) is a current signal. Therefore, a terminating resistor must be used to produce a voltage drop so that the current signal is converted into a voltage signal. As the C-circuit board is small-sized and comprises a lot of components disposed thereon, the terminating resistor Zt is usually disposed on the X-circuit board. This practice of disposing the terminating resistor on the X-circuit board requires additional electric tests to be made on the X-circuit board, which adds to the cost.

SUMMARY OF THE INVENTION

A primary objective of the present disclosure is to provide a data driving system and a data driving chip for a liquid crystal panel as well as a liquid crystal display (LCD) device comprising the same, which have a terminating resistor disposed inside the data driving chip to eliminate the need of additional electric tests.

To achieve this objective, the present disclosure provides a data driving chip for a liquid crystal panel. The data driving chip is connected to a timing controller via a first interface. The first interface comprises a terminating resistor for converting a current signal transmitted through the first interface into a voltage signal, and the terminating resistor is disposed inside the data driving chip.

Preferably, the first interface is a mini-LVDS interface.

Preferably, the terminating resistor is a programmable resistor whose resistance value can be adjusted according to setting codes.

Preferably, the data driving chip further comprises a second interface connected with the timing controller to receive the setting codes for adjusting the resistance value of the terminating resistor.

Preferably, the second interface is an I2C (Inter IC) interface.

To achieve the aforesaid objective, the present disclosure provides a data driving system for a liquid crystal panel. The data driving system comprises a data driving chip, a timing controller and a first interface connected to the data driving chip and the timing controller. The first interface comprises a terminating resistor for converting a current signal transmitted through the first interface into a voltage signal, and the terminating resistor is disposed inside the data driving chip.

Preferably, the terminating resistor is a programmable resistor whose resistance value can be adjusted according to setting codes, the data driving system further comprises a second interface connected with the data driving chip and the timing controller, and the timing controller transmits the setting codes to the data driving chip via the second interface.

Preferably, the data driving system further comprises a storage chip connected to the timing controller and configured to store the setting codes.

Preferably, the data driving system further comprises a pulse width modulation (PWM) chip for supplying an operating voltage to the data driving chip, the timing controller and the storage chip respectively.

Preferably, the first interface is a mini-LVDS interface and the second interface is an I2C interface.

To achieve the aforesaid objective, the present disclosure provides a liquid crystal display (LCD) device, which comprises a liquid crystal panel and a data driving system. The data driving system is configured to drive the liquid crystal panel. The data driving system comprises a data driving chip, a timing controller and a first interface connected to the data driving chip and the timing controller. The first interface comprises a terminating resistor for converting a current signal transmitted through the first interface into a voltage signal, and the terminating resistor is disposed inside the data driving chip.

Preferably, the LCD device further comprises a first circuit board and a second circuit board which are independent of the liquid crystal panel, the data driving chip is disposed on the liquid crystal panel, and the timing controller is disposed on the first circuit board, and the first interface is partly disposed on the second circuit board. Here, the first circuit board is a C-circuit board, and the second circuit board is an X-circuit board.

Preferably, the terminating resistor is a programmable resistor whose resistance value can be adjusted according to setting codes, the data driving system further comprises a second interface connected with the data driving chip and the timing controller, and the timing controller transmits the setting codes to the data driving chip via the second interface.

Preferably, the data driving system further comprises a storage chip connected to the timing controller and configured to store the setting codes.

Preferably, the data driving system further comprises a PWM chip for supplying an operating voltage to the data driving chip, the timing controller and the storage chip respectively.

Preferably, the LCD device further comprises a first circuit board and a second circuit board which are independent of the liquid crystal panel; the data driving chip is disposed on the liquid crystal panel, the timing controller is disposed on the first circuit board, and the first interface is partly disposed on the second circuit board; the terminating resistor is a programmable resistor whose resistance value can be adjusted according to the setting codes, the data driving system further comprises a second interface connected with the data driving chip and the timing controller, and the timing controller transmits the setting codes to the data driving chip via the second interface; and the data driving system further comprises a storage chip connected to the timing controller and configured to store the setting codes and a PWM chip configured to supply an operating voltage to the data driving chip, the timing controller and the storage chip respectively.

Preferably, the first interface is a mini-LVDS interface and the second interface is an I2C interface.

The present disclosure has the following disclosures: as compared to the prior art which has the terminating resistor disposed on the X-circuit board and consequently requires additional electric tests to be made at an additional cost, the present disclosure has the terminating resistor disposed inside the data driving chip to eliminate the need of additional electric tests, thus saving the cost of the electric tests.

DETAILED DESCRIPTION OF THE INVENTION

The present disclosure is more particularly described in the following examples that are intended as illustrative only since numerous modifications and variations therein will be apparent to those skilled in the art.

Figure 1:
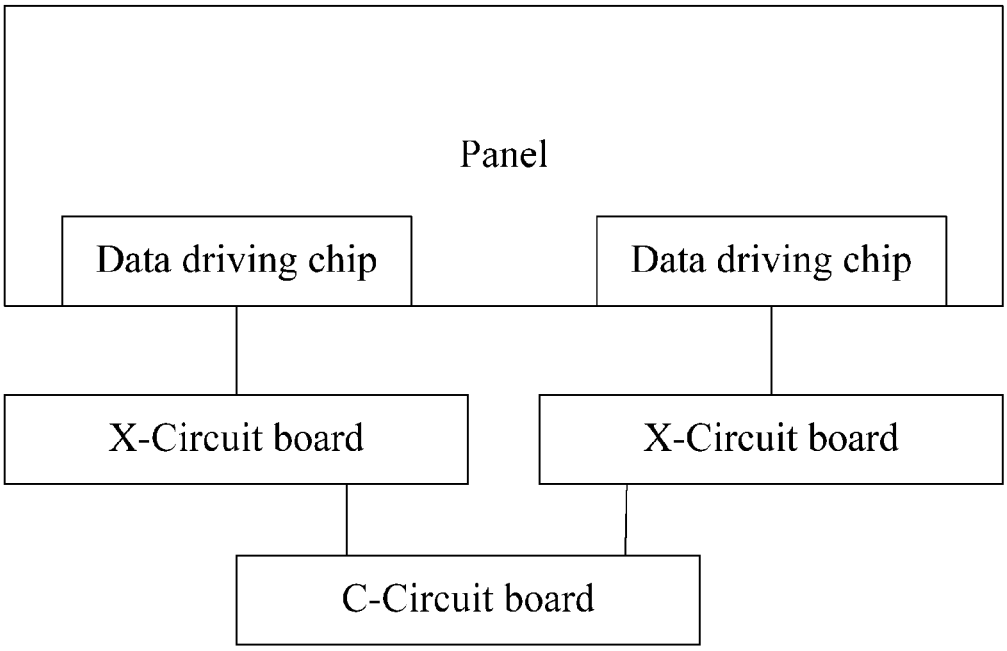
FIG. 1 (Prior Art)
FIG. 1 is a schematic view of a panel driving architecture for prior art LCD devices in which X-circuit boards and a C-circuit board are formed separately.
Figure 2:
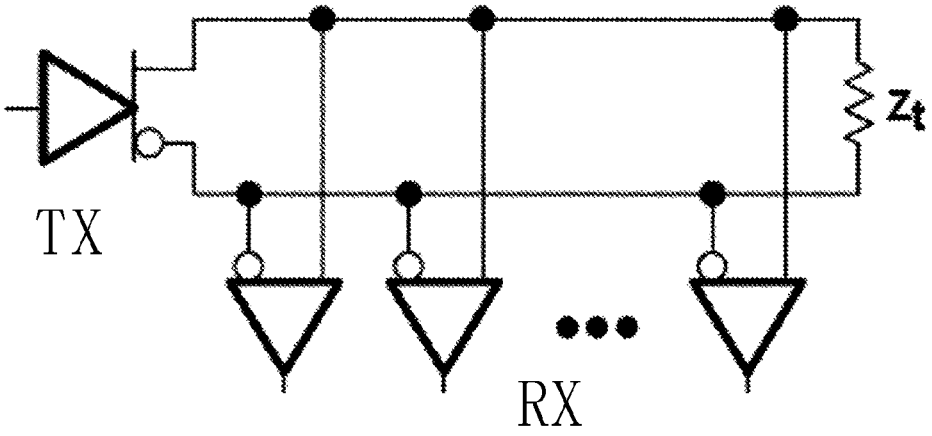
FIG. 2 (Prior Art)
FIG. 2 is a schematic view illustrating connections of a mini-LVDS in the prior art.
Figure 3:
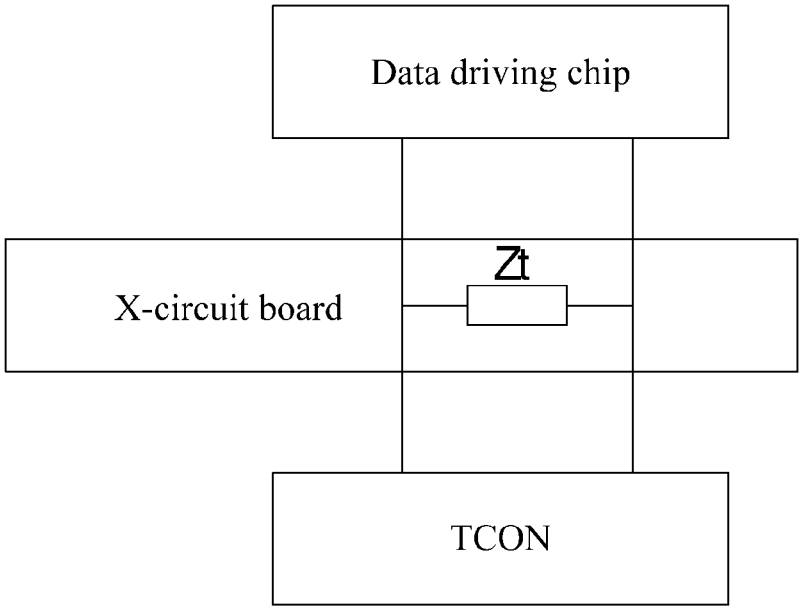
FIG. 3 (Prior Art)
FIG. 3 is a schematic view illustrating a position where a terminating resistor is connected in the prior art.
Figure 4:
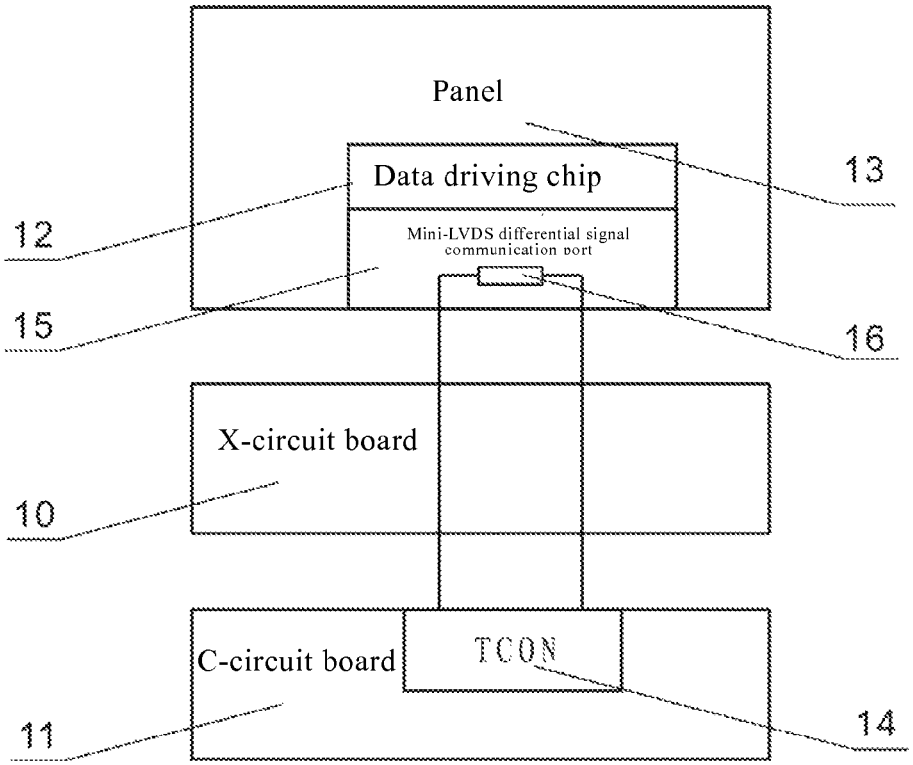
FIG. 4 is a schematic structural view of a first embodiment of a panel data driving system according to the present disclosure.
Figure 5:
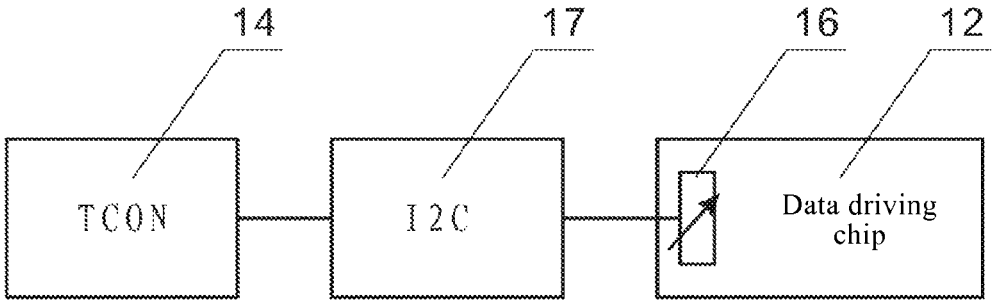
FIG. 5 is a schematic structural view illustrating bus communications in the panel data driving system according to the present disclosure.

Referring to FIGS. 4 and 5 together, FIG. 4 is a schematic structural view of a first embodiment of a panel data driving system according to the present disclosure, and FIG. 5 is a schematic structural view illustrating bus communications in the panel data driving system according to the present disclosure. As shown in FIG. 4, the panel data driving system comprises an X-circuit board 10, a C-circuit board 11, a data driving chip 12 and a panel 13. The C-circuit board 11 is connected via the X-circuit board 10 to the data driving chip 12 which is, in turn, connected to the panel 13. The C-circuit board 11 has a timing controller TCON 14 disposed thereon. The data driving chip 12 comprising a mini-LVDS differential signal communication port 15 in communication with the timing controller TCON 14, and a terminating resistor 16 for converting a current signal into a voltage signal is disposed in the mini-LVDS differential signal communication port 15.

As can be appreciated from the above description, the present disclosure overcomes the shortcoming of the prior art that having the terminating resistor disposed on the X-circuit board requires additional electric tests to be made at an additional cost. Specifically, the present disclosure has the terminating resistor disposed inside the data driving chip to eliminate the need of additional electric tests, so the cost of making the additional electric tests on the X-circuit board is saved.

In the embodiment of the data driving chip 12 of the present disclosure, the data driving chip 12 comprises the mini-LVDS differential signal communication port 15 in communication with the timing controller TCON 14, and the terminating resistor 16 for converting a current signal into a voltage signal is disposed in the mini-LVDS differential signal communication port 15. The terminating resistor 16 is a programmable resistor whose resistance value can be adjusted according to setting codes. Therefore, by use of the setting codes, the resistance value of the terminating resistor 16 can be adjusted as desired so that the data driving chip 12 provided with the terminating resistor 16 has an appropriate resistance value for converting the current signal into a voltage signal, thus accomplishing the signal conversion of the mini-LVDS differential signal communication port 15.

As shown in FIG. 5, the driving system shown therein comprises the TON 14, the mini-LVDS differential signal communication port 15 (see FIG. 4), the terminating resistor 16, an I2C bus interface 17 and the data driving chip 12. The I2C bus interface 17 is configured to adjust the resistance value of the terminating resistor 16 disposed inside the data driving chip, and the TCON 14 is connected to the data driving chip 12 via the I2C bus interface 17.

In this embodiment, the terminating resistor of the mini-LVDS differential signal communication port 15 is disposed inside the data driving chip. Then, considering that the number of data driving chips that are needed varies with the type of the liquid crystal panel and a sum of resistance values of terminating resistors integrated in all the chips shall be equal to a preset value (e.g., 100Ω), it is necessary to adjust the resistance value of the terminating resistor of each of the driving chip. In this embodiment, one-time programming is made through I2C to ensure that the sum of resistance values is equal to the required value of 100Ω. Of course, the preset value of 100Ω is only provided as an example, but is not intended to limit the scope of the present disclosure.

Figure 6:
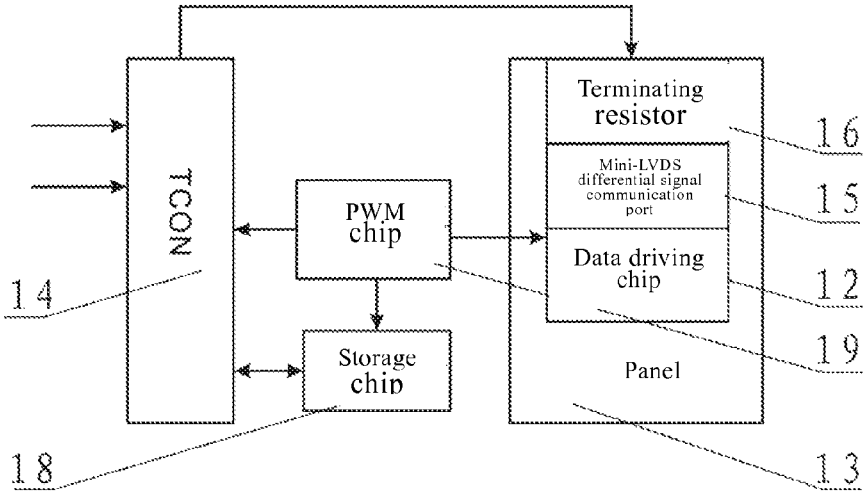
FIG. 6 is a schematic structural view of a second embodiment of the panel data driving system according to the present disclosure.
Figure 7:
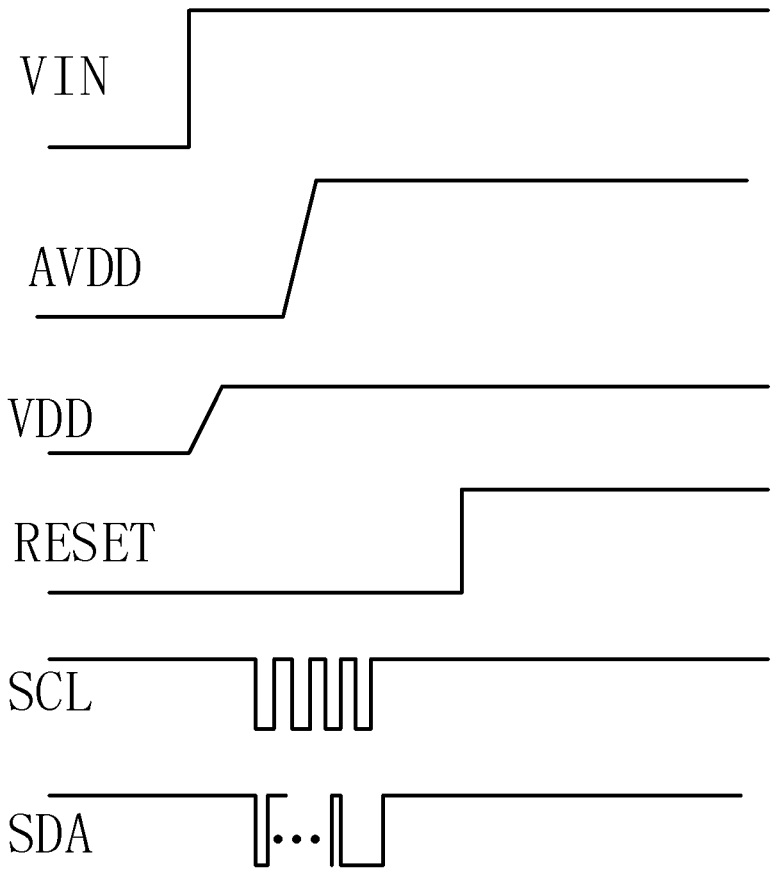
FIG. 7 is a power-up timing diagram of the second embodiment of the panel data driving system according to the present disclosure.

Referring to FIGS. 6 and 7 together, FIG. 6 is a schematic structural view of a second embodiment of the panel data driving system according to the present disclosure, and FIG. 7 is a power-up timing diagram of the second embodiment of the panel data driving system according to the present disclosure. The panel data driving system shown therein comprises the data driving chip 12, the panel 13, the TCON 14, a storage chip 18 and a pulse width modulation (PWM) chip 19. The storage chip is connected to the TCON 14 and configured to store the setting codes for adjusting the resistance value of the terminating resistor 16. The PWM chip 19 is configured to supply an operating voltage for the data driving chip 12, the timing controller TCON 14 and the storage chip 18 respectively.

A preferred embodiment of the present disclosure operates as follows: when the power input terminal VIN (12V) is powered up, the PWM chip 19 (PWM IC) is activated to supply voltages VDD and AVDD to a logic portion and an analog portion respectively. Then, the TCON 14 reads data from the storage chip 18 (EEPROM) into a register of the TCON 14. Thereafter, before a RESET signal (usually the duration between a time when VDD become high and a time when the RESET signal become high is set to be 100 ms) is activated, the setting codes for the resistance value of the terminating resistor 16 that are set in the mini-LVDS differential signal communication port 15 of the data driving chip 12 are transmitted to the data driving chip 12 in one go via the I2C bus to accomplish the programming of this time. Afterwards, the resistance value of the terminating resistor 16 inside the driving chip 12 is kept constant until the setting codes disappear when the power is off. Then, the process described above will be repeated each time the power input terminal VIN is powered up. Of course, once the number of data driving chips 12 that are necessary for a specific type of liquid crystal panel is determined, the resistance values of the terminating resistors 16 inside the data driving chip 12 may be fixed through one-time programming before delivery of the driving chips.

Referring next to FIGS. 4 through 6, in an embodiment of an LCD device using the panel data driving system of the present disclosure, the LCD device comprises an X-circuit board 10, a C-circuit board 11, a data driving chip 12 and a panel 13. The C-circuit board 11 is connected to the data driving chip 12 via the X-circuit board 10, and the data driving chip 12 is connected to the panel 13. The C-circuit board 11 has the TCON 14 disposed thereon. The mini-LVDS interface is partly disposed on the X-circuit board. The data driving chip 12 comprises the mini-LVDS differential signal communication port 15 in communication with the TCON 14, and the mini-LVDS differential signal communication port 15 is provided with the terminating resistor 16 thereon for converting a current signal into a voltage signal. The LCD device further comprises an I2C bus interface 17 for adjusting a resistance value of the terminating resistor disposed inside the data driving chip, and the TCON 14 is connected to the data driving chip 12 via the I2C bus interface 17. The LCD device further comprises the storage chip 18 connected to the timing controller TCON 14 and configured to store the setting codes for adjusting the resistance value of the terminating resistor. The LCD device further comprises the PWM chip 19 configured to supply an operating voltage for the data driving chip 12, the timing controller TCON 14 and the storage chip 18 respectively.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A data driving chip for a liquid crystal panel, wherein the data driving chip is connected to the liquid crystal panel and a timing controller arranged on a control circuit board independent of the liquid crystal panel via a mini-LVDS (mini-Low Voltage Differential Signaling) interface embedded inside the data driving chip, the data driving chip with the mini-LVDS interface embedded therein is disposed on the liquid crystal panel, at least one X-circuit board is arranged between the timing controller arranged on the control circuit board and the data driving chip disposed on the liquid crystal panel for transmitting signals from the control circuit board to the data driving chip, the mini-LVDS interface comprises a terminating resistor embedded inside the mini-LVDS interface for converting a current signal transmitted through the mini-LVDS interface into a voltage signal, the terminating resistor is a programmable resistor whose resistance value can be adjusted according to setting codes, wherein a storage chip is connected to the timing controller for storing the setting codes, and a pulse width modulation (PWM) chip is connected the timing controller, the data driving chip and the storage chip for supplying an operating voltage to the data driving chip, the timing controller and the storage chip respectively;

wherein when a power input terminal is powered up, the PWM chip is activated to supply a first voltage and a second voltage to a logic portion and an analog portion respectively, then the time controller reads data from the storage chip into a register of the time controller, the setting codes for the resistance value of the terminating resistor are set in the mini-LVDS differential signal communication port of the data driving chip and the setting codes are transmitted to the data driving chip in one go before a RESET signal is activated, to accomplish one programming of this time, and the resistance value of the terminating resistor of the driving chip is kept constant until the setting codes disappear when the power is off.

2. The data driving chip of claim 1, wherein the data driving chip further comprises an I2C (Inter IC) interface connected with the timing controller to receive the setting codes for adjusting the resistance value of the terminating resistor.

3. The data driving chip of claim 1, wherein the setting codes for the resistance value of the terminating resistor are set in the mini-LVDS differential signal communication port of the data driving chip and the setting codes are transmitted to the data driving chip in one go during a duration between a time when the first voltage becomes high and another time when the RESET signal becomes high.

4. The data driving chip of claim 3, wherein the duration is set to be 100 ms.

5. A data driving system for a liquid crystal panel, comprising a data driving chip, a timing controller arranged on a control circuit board independent of the liquid crystal panel, and a mini-LVDS (mini-Low Voltage Differential Signaling) interface embedded inside the data driving chip and connected to the data driving chip and the timing controller, wherein the data driving chip with the mini-LVDS interface embedded therein is disposed on the liquid crystal panel, at least one X-circuit board is arranged between the timing controller arranged on the control circuit board and the data driving chip disposed on the liquid crystal panel for transmitting signals from the control circuit board to the data driving chip, the mini-LVDS interface comprises a terminating resistor embedded inside the mini-LVDS interface for converting a current signal transmitted through the mini-LVDS interface into a voltage signal, the terminating resistor is a programmable resistor whose resistance value can be adjusted according to setting codes, wherein the data driving system further comprises a storage chip connected to the timing controller for storing the setting codes, and a pulse width modulation (PWM) chip connected the timing controller, the data driving chip and the storage chip for supplying an operating voltage to the data driving chip, the timing controller and the storage chip respectively;

wherein when a power input terminal is powered UP, the PWM chip is activated to supply a first voltage and a second voltage to a logic portion and an analog portion respectively, then the time controller reads data from the storage chip into a register of the time controller, the setting codes for the resistance value of the terminating resistor are set in the mini-LVDS differential signal communication port of the data driving chip and the setting codes are transmitted to the data driving chip in one go before a RESET signal is activated, to accomplish one programming of this time, and the resistance value of the terminating resistor of the driving chip is kept constant until the setting codes disappear when the power is off.

6. The data driving system of claim 5, wherein the data driving system further comprises an I2C (Inter IC) interface connected with the data driving chip and the timing controller, and the timing controller transmits the setting codes to the data driving chip via the I2C interface.

7. The data driving system of claim 5, wherein the setting codes for the resistance value of the terminating resistor are set in the mini-LVDS differential signal communication port of the data driving chip and the setting codes are transmitted to the data driving chip in one go during a duration between a time when the first voltage becomes high and another time when the RESET signal becomes high.

8. The data driving system of claim 7, wherein the duration is set to be 100 ms.

9. A liquid crystal display (LCD) device, comprising a liquid crystal panel and a data driving system, wherein the data driving system is configured to drive the liquid crystal panel, the data driving system comprises a data driving chip, a timing controller arranged on a control circuit board apart from the liquid crystal panel and a mini-LVDS (mini-Low Voltage Differential Signaling) interface embedded inside the data driving chip and connected to the data driving chip and the timing controller, the data driving chip with the mini-LVDS interface embedded therein is disposed on the liquid crystal panel, at least one X-circuit board is arranged between the timing controller arranged on the control circuit board and the data driving chip disposed on the liquid crystal panel for data driving chip, the mini-LVDS interface comprises a terminating resistor embedded inside the mini-LVDS interface for converting a current signal transmitted through the mini-LVDS interface into a voltage signal, the terminating resistor is a programmable resistor whose resistance value can be adjusted according to setting codes, wherein the data driving system further comprises a storage chip connected to the timing controller for storing the setting codes, and a pulse width modulation (PWM) chip connected the timing controller, the data driving chip and the storage chip for supplying an operating voltage to the data driving chip, the timing controller and the storage chip respectively;

wherein when a power input terminal is powered up, the PWM chip is activated to supply a first voltage and a second voltage to a logic portion and an analog portion respectively, then the time controller reads data from the storage chip into a register of the time controller, the setting codes for the resistance value of the terminating resistor are set in the mini-LVDS differential signal communication port of the data driving chip and the setting codes are transmitted to the data driving chip in one go before a RESET signal is activated, to accomplish one programming of this time, and the resistance value of the terminating resistor of the driving chip is kept constant until the setting codes disappear when the power is off.

10. The LCD device of claim 9, wherein the data driving system further comprises an I2C (Inter IC) interface connected with the data driving chip and the timing controller, and the timing controller transmits the setting codes to the data driving chip via the I2C interface.

11. The LCD device of claim 9, wherein the setting codes for the resistance value of the terminating resistor are set in the mini-LVDS differential signal communication port of the data driving chip and the setting codes are transmitted to the data driving chip in one go during a duration between a time when the first voltage becomes high and another time when the RESET signal becomes high.

12. The LCD device of claim 11, wherein the duration is set to be 100 ms.

* * * * *